US008387523B2

(12) United States Patent
Yang

(10) Patent No.: US 8,387,523 B2
(45) Date of Patent: Mar. 5, 2013

(54) ROCKER ASSEMBLY OF A STRAPPING MACHINE

(75) Inventor: Ming-Shih Yang, New Taipei (TW)

(73) Assignee: Pantech International Inc., New Taipei (TW)

( * ) Notice: Subject to any disclaimer, the term of this patent is extended or adjusted under 35 U.S.C. 154(b) by 74 days.

(21) Appl. No.: 13/186,503

(22) Filed: Jul. 20, 2011

(65) Prior Publication Data

US 2013/0019764 A1 Jan. 24, 2013

(51) Int. Cl.
*B65B 13/22* (2006.01)

(52) U.S. Cl. ..... 100/32; 100/29; 140/93.2; 156/391; 156/494; 156/580; 156/73.5

(58) Field of Classification Search ..... 100/29, 100/32, 33 PB; 140/93.2; 156/73.5, 391, 156/502, 494, 580, 580.2; 254/213, 216
See application file for complete search history.

(56) References Cited

U.S. PATENT DOCUMENTS

| | | | | |
|---|---|---|---|---|
| 4,015,643 | A * | 4/1977 | Cheung | 140/93.4 |
| 4,313,779 | A * | 2/1982 | Nix | 156/361 |
| 5,133,532 | A * | 7/1992 | Figiel et al. | 254/216 |
| 6,328,087 | B1 * | 12/2001 | Finzo et al. | 156/494 |
| 6,405,776 | B1 * | 6/2002 | Rauch | 156/391 |

* cited by examiner

*Primary Examiner* — Jimmy T Nguyen
(74) *Attorney, Agent, or Firm* — Pearne & Gordon LLP

(57) ABSTRACT

A rocker assembly of a strapping machine has a rocker having a seat, a positioning panel mounted on the seat and being able to swing, and two teeth panels slidably mounted on the positioning panel. When a fixed end and a tightening end of a wrapping strap are mounted between the rocker assembly and a tensioning wheel, the teeth panels slide and the positioning panel swings to adjust engaging surfaces and engaging forces between the teeth panels and the wrapping strap according to thickness of the wrapping strap. Thus the wrapping strap is able to securely wrap around the goods and is not scratched.

13 Claims, 17 Drawing Sheets

ROCKER ASSEMBLY OF A STRAPPING MACHINE

BACKGROUND OF THE INVENTION

1. Field of the Invention

The present invention relates to a rocker assembly of a strapping machine, especially to a rocker assembly that automatically adjusts engagement between teeth panels and a wrapping strap according to thickness of the wrapping strap.

2. Description of the Prior Art(s)

A strapping machine straps packaged goods with steel or plastic wrapping straps so the strapped goods are convenient to transport.

With reference to FIG. 16, a conventional strapping machine comprises a tensioning wheel 91 and a rocker 92. The tensioning wheel 91 is driven by a power device to rotate in a specific direction and has multiple engaging teeth 911 formed around a peripheral surface of the tensioning wheel 91. The rocker 92 is pivotally mounted on the conventional strapping machine and has a pivoting end 921, a swinging end 922 and a teeth panel 93. The pivoting end 921 is pivotally mounted on the conventional strapping machine. The swinging end 922 moves forwards or backwards relative to the peripheral surface of the tensioning wheel 91 as the rocker 92 swings. The teeth panel 93 is embedded in the rocker 92, is disposed adjacent to the swinging end 922 of the rocker 92 and has an upper surface and multiple engaging teeth 931. The upper surface of the engaging teeth panel 93 is concave and corresponds to the peripheral surface of the tensioning wheel 91. The engaging teeth 931 of the teeth panel 93 are formed on the upper surface of the teeth panel 93 and correspond to the engaging teeth 911 of the tensioning wheel 91. Preferably, the teeth panel 93 may comprise multiple sub-panels having upper surfaces with different slopes.

A wrapping strap 94 is wrapped around the goods and has a tightening end 941 and a fixed end 942. The fixed end 942 and the tightening end 941 overlap. Then the fixed end 942 and the tightening end 941 are placed between the tensioning wheel 91 and the teeth panel 93.

With further reference to FIG. 17, the rocker 92 is driven to swing toward the tensioning wheel 91 to allow the engaging teeth 911 of the tensioning wheel 91 to engage the tightening end 941 of the wrapping strap 94 and the engaging teeth 931 of the teeth panel 93 to engage the fixed end 941 of the wrapping strap 94. When the tensioning wheel 91 is rotated, the tightening end 941 of the wrapping strap 94 is moved while the fixed end 942 of the wrapping strap 94 is held by the teeth panel 93. As the wrapping strap 94 is properly tensioned, a welding device of the conventional strapping machine welds the overlapping tightening and fixed ends 941, 942 of the wrapping strap 94 so the wrapping strap 94 is wrapped around the goods.

However, in the above-mentioned conventional strapping machine, the teeth panel 93 is securely mounted on the rocker 92. Therefore, when the teeth panel 93 and the tensioning wheel 91 engage the wrapping strap 94, the teeth panel 93 is unable to move relative to the rocker 92 according to thickness of the wrapping strap 94 to securely hold the wrapping strap 94. Thus, engagements between the teeth panel 93 and the wrapping strap 94 and between the tensioning wheel 91 and the wrapping strap 94 are loose. Consequently, the wrapping strap 94 is unable to securely wrap around the goods. Furthermore, since the tensioning wheel 91 does not securely hold the wrapping strap 94, when the tensioning wheel 91 rotates, the engaging teeth 911 of the tensioning wheel 91 scratch the wrapping strap 94 easily.

With further reference to FIG. 18, in view of the disadvantages of the foregoing conventional strapping machine, a rocker 95 of another conventional strapping machine has a pivoting end 952, a mounting recess 953, a bottom, a through hole 954, a teeth panel 96 and a bolt 97. The mounting recess 953 is formed in an upper surface of the rocker 95 and is disposed adjacent to the pivoting end 952 of the rocker 95. The bottom of the rocker 95 is defined in the mounting recess 953. The through hole 954 is formed through the bottom of the rocker 95. The teeth panel 96 is mounted in the mounting recess 953 of the rocker 95 and has a toothed upper surface 961 and a convex lower surface 962. The bolt 97 is mounted through the through hole 954 of the rocker 95 from a lower surface of the rocker 95, is attached to the teeth panel 96 and is thinner than the through hole 954 of the rocker 95 so the bolt 97 is slidable in the through hole 954 and the teeth panel 96 slides as well. When a tightening end and a fixed end of a wrapping strap are mounted between the teeth panel 96 and a tensioning wheel 98, the convex lower surface 962 of the teeth panel 96 allows the teeth panel 96 to swing and to slightly slide. Thus, angle and position of the teeth panel 96 can be adjusted according to thickness of the wrapping strap and the tensioning wheel 98 so the wrapping strap is securely held by the teeth panel 96 and the tensioning wheel 98.

However, since the teeth panel 96 of the above-mentioned conventional strapping machine is formed in a single piece, when the teeth panel 96 swings, only part of the toothed upper surface 961 engages the wrapping strap. Engagement between the teeth panel 96 and the wrapping strap is still loose and the wrapping strap drops out of the rocker 95 and the tensioning wheel 98 easily.

SUMMARY OF THE INVENTION

The main objective of the present invention is to provide a rocker assembly of a strapping machine. The rocker assembly has a rocker having a seat, a positioning panel mounted on the seat and being able to swing, and two teeth panels slidably mounted on the positioning panel. When a fixed end and a tightening end of a wrapping strap are mounted between the rocker assembly and a tensioning wheel, the teeth panels slide and the positioning panel swings to adjust engaging surfaces and engaging forces between the teeth panels and the wrapping strap according to thickness of the wrapping strap. Thus the wrapping strap is able to securely wrap around the goods and is not scratched.

DETAILED DESCRIPTION OF THE PREFERRED EMBODIMENTS

Figure 1:
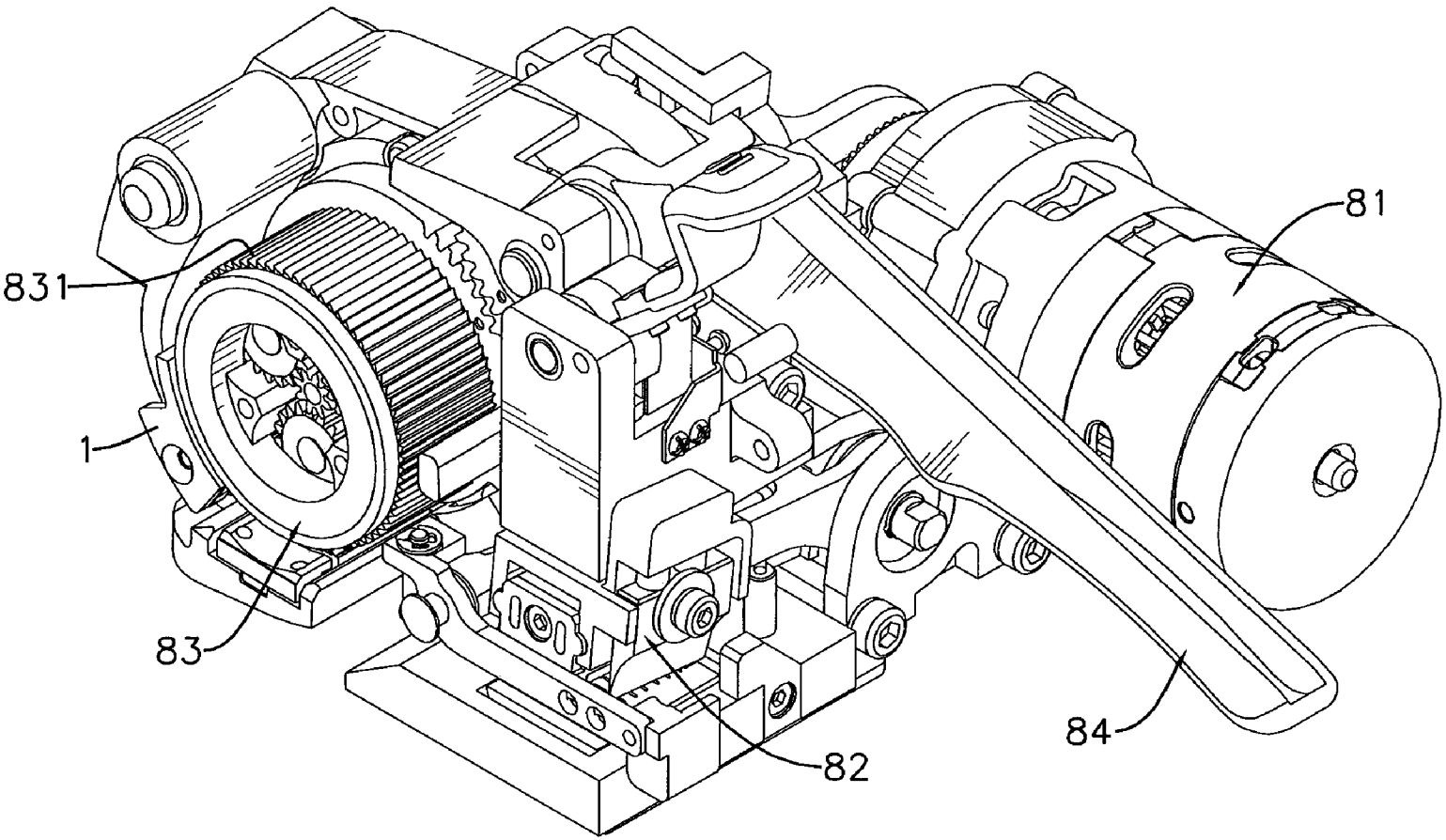
FIG. 1 is a perspective view of a strapping machine with a first embodiment of a rocker assembly in accordance with the present invention.

With reference to FIG. 1, a strapping machine has a power device 81, a welding device 82, a tensioning wheel 83, a rocker lever 84 and a rocker assembly 1 in accordance with the present invention. The tensioning wheel 83 is driven by the power device 81 to rotate in a specific direction and has multiple teeth 831 formed around a peripheral surface of the tensioning wheel 83. The rocker lever 84 is pivotally mounted on the strapping machine.

Figure 2:
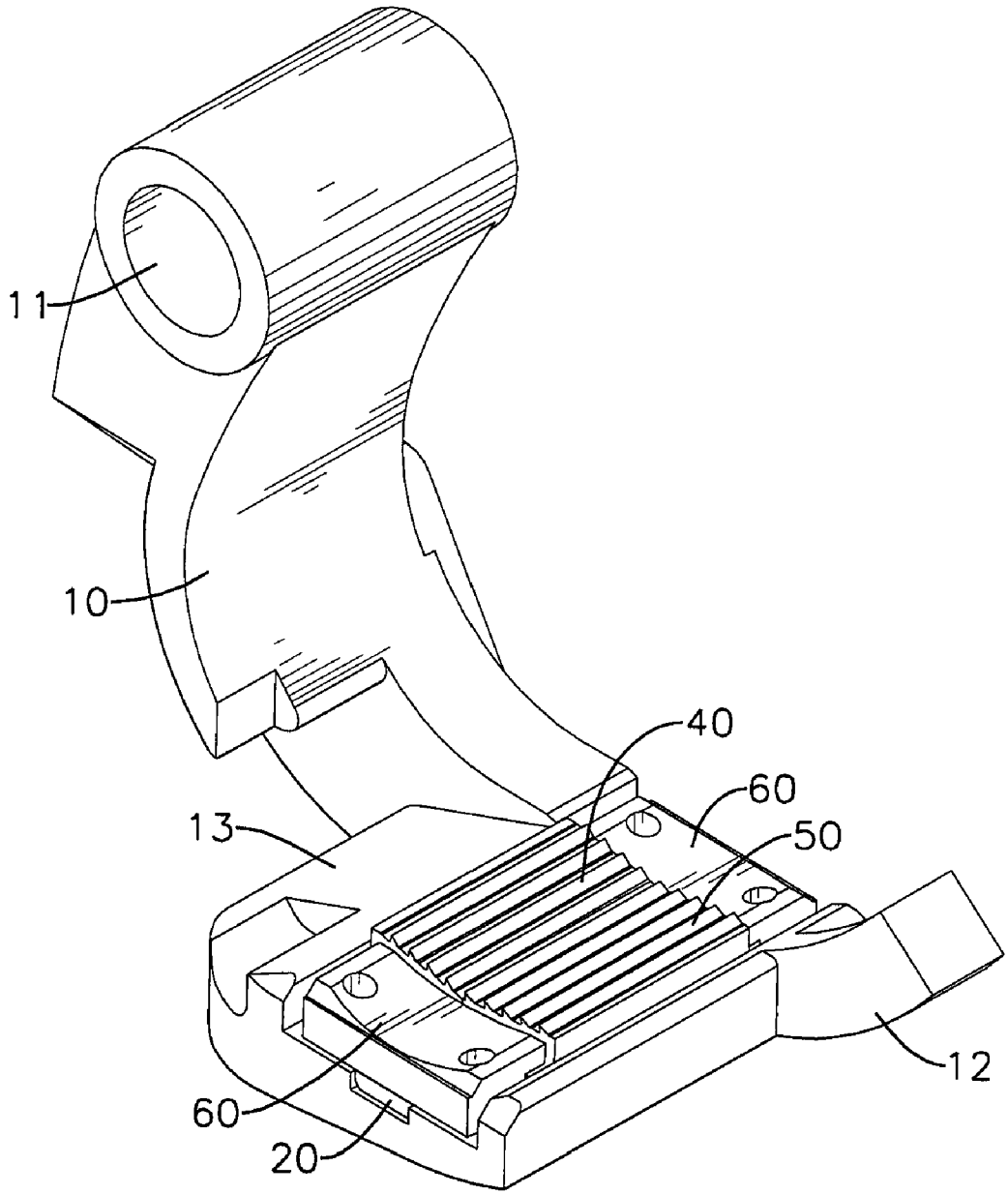
FIG. 2 is a perspective view of the rocker assembly in FIG. 1.
Figure 3:
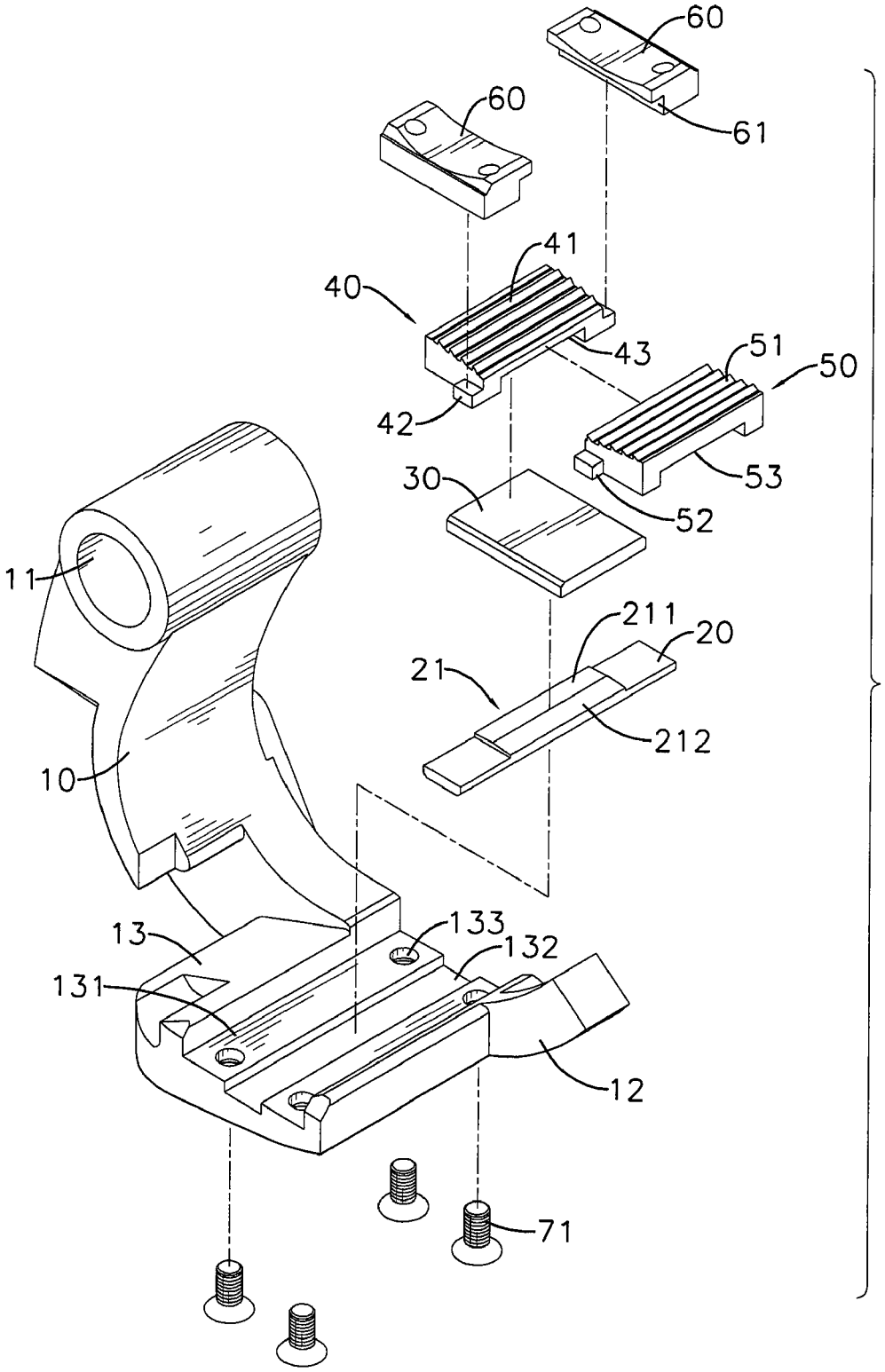
FIG. 3 is an exploded perspective view of the rocker assembly in FIG. 1.
Figure 4:
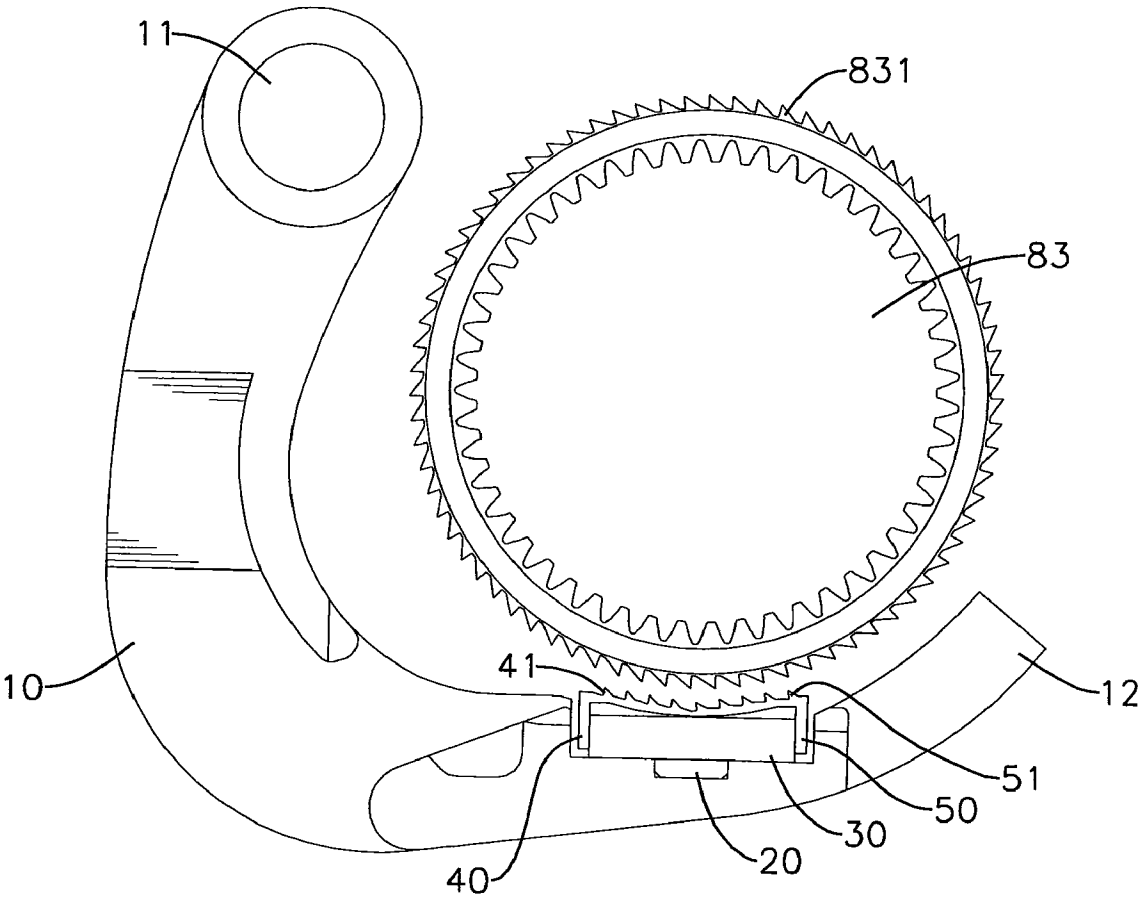
FIG. 4 is a partial operational side view of the strapping machine in FIG. 1.

With further reference to FIGS. 2 and 3, the rocker assembly 1 is pivotally mounted on the strapping machine, is disposed beside the tensioning wheel 83, is driven by the rocker lever 84 to swing backward or toward the tensioning wheel 83 and has a rocker 10, a positioning panel 30, two teeth panels 40, 50 and two holders 60.

With further reference to FIGS. 7, 11, 13, 14, 15, the rocker 10 is arced and has a pivoting end 11, a swinging end 12 and a seat 13, 13A, 13B, 13C, 13D, 13E. The pivoting end 11 is pivotally mounted on the strapping machine. The swinging end 12 moves backwards or forwards relative to the tensioning wheel 83 as the rocker 10 swings.

The seat 13, 13A, 13B, 13C, 13D, 13E is formed on the rocker 10, is disposed adjacent to the swinging end 12 and has a front, a rear, two opposite sides, a mounting recess 131, 131A, 131B, 131C, 131D, 131E, a bottom, and a supporting protrusion 21, 21A, 21B, 21C, 21D, 21E. The front of the seat 13, 13A, 13B, 13C, 13D, 13E corresponds to the pivoting end 11 of the rocker 10. The rear of the seat 13, 13A, 13B, 13C, 13D, 13E corresponds to the swinging end 12 of the rocker 10. The mounting recess 131, 131A, 131B, 131C, 131D, 131E is formed in an upper surface of the seat 13, 13A, 13B, 13C, 13D, 13E. The bottom is defined in the mounting recess 131, 131A, 131B, 131C, 131D, 131E. The supporting protrusion 21, 21A, 21B, 21C, 21D, 21E is formed on the bottom of the seat 13, 13A, 13B, 13C, 13D, 13E and extends toward the opposite sides of the seat 13, 13A, 13B, 13C, 13D, 13E.

With reference to FIGS. 4, 7, 11, 13, 14, 15, the seat 13, 13A, 13B, 13C, 13D, 13E may further have an internal recess 132, 132A, 132B, 132C, 132D, 132E formed in the bottom of the seat 13, 13A, 13B, 13C, 13D, 13E and extending toward the sides of the seat 13, 13A, 13B, 13C, 13D, 13E.

Figure 5:
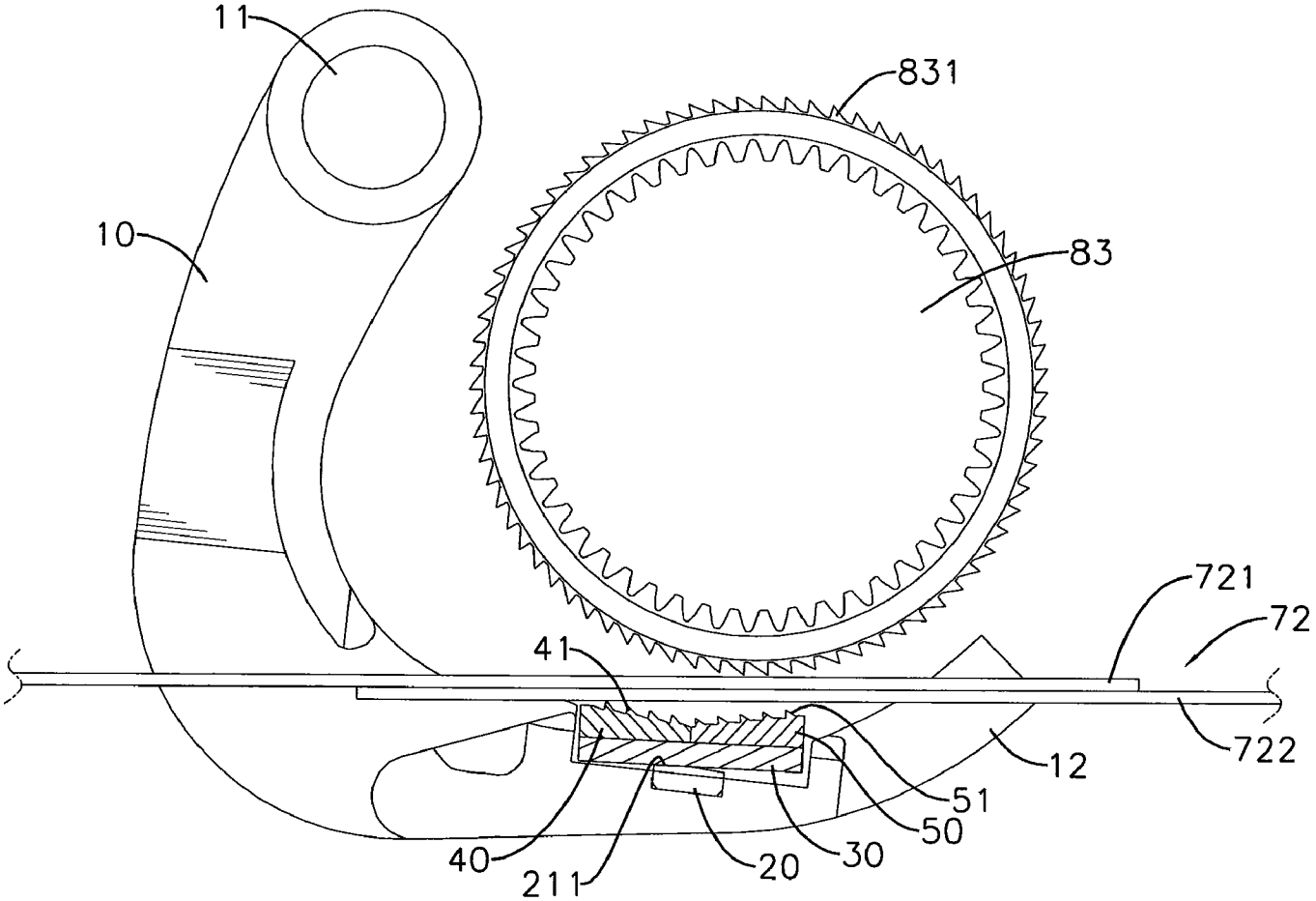
FIG. 5 is a partial operational side view of the strapping machine in FIG. 1, showing a wrapping strap mounted between the rocker assembly and a tensioning wheel.
Figure 6:
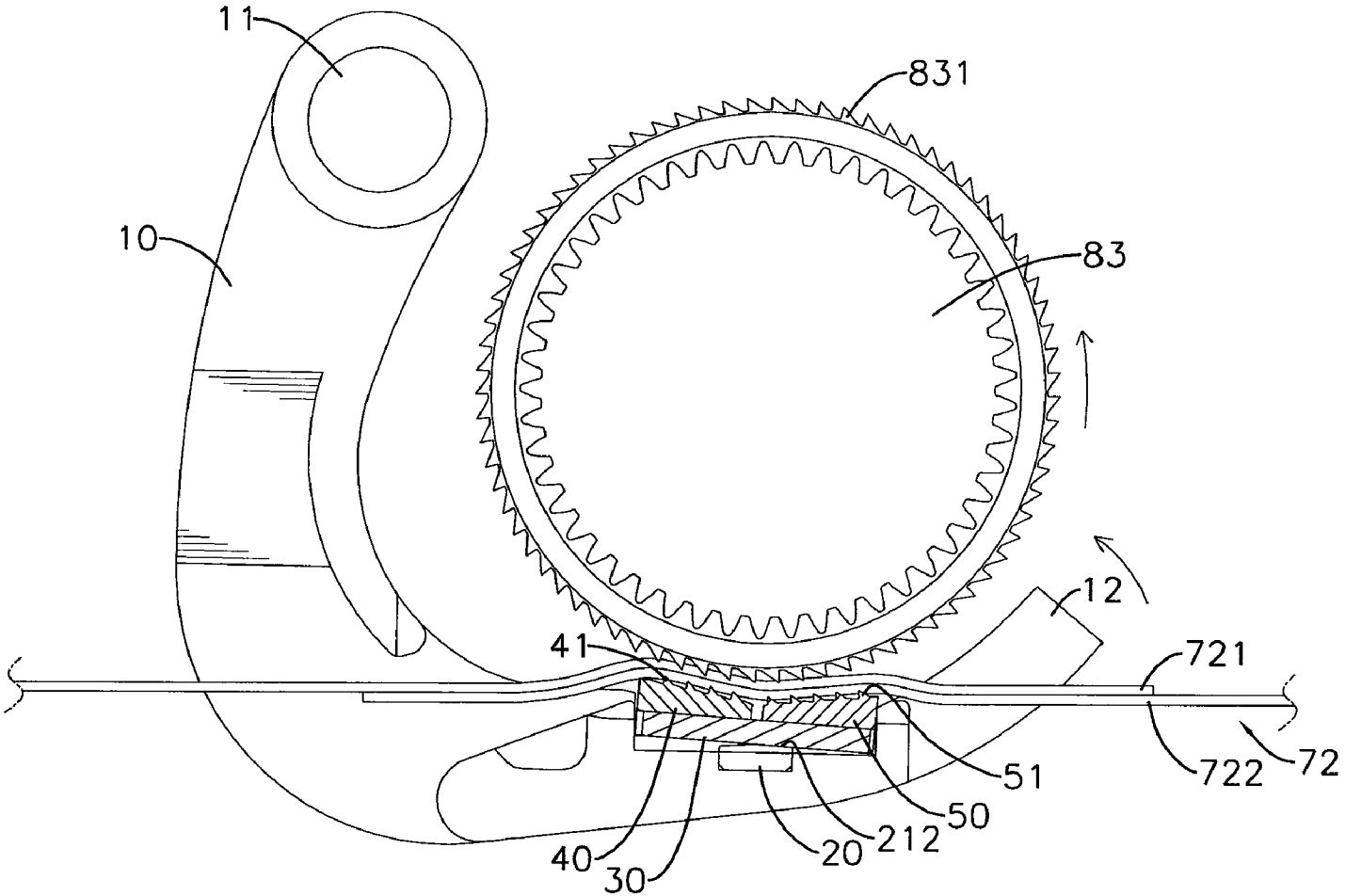
FIG. 6 is a partial operational side view of the strapping machine in FIG. 1, showing the rocker assembly and the tensioning wheel engaging the wrapping strap.
Figure 7:
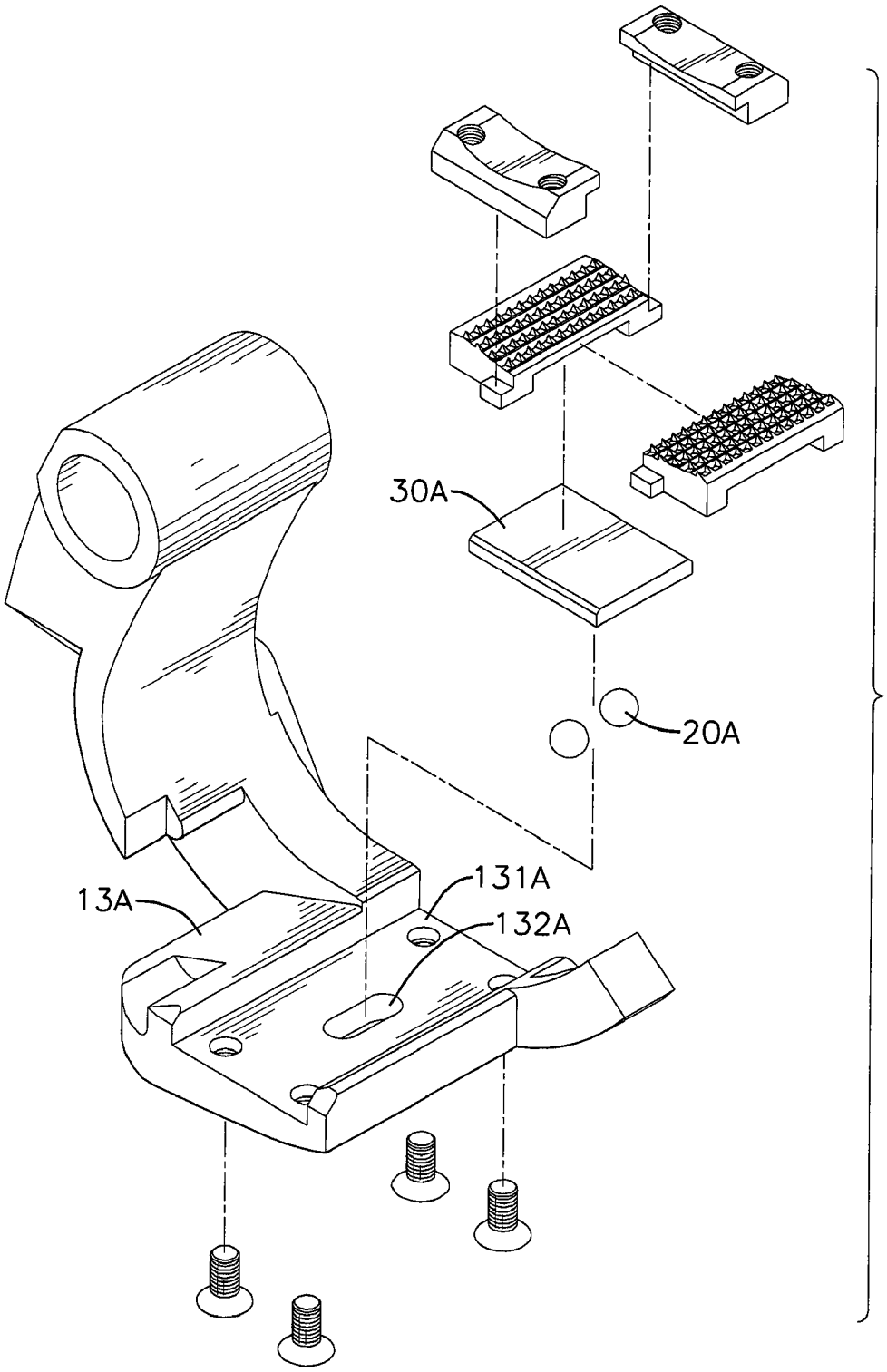
FIG. 7 is an exploded perspective view of a second embodiment of a rocker assembly of a strapping machine in accordance with the present invention.
Figure 8:
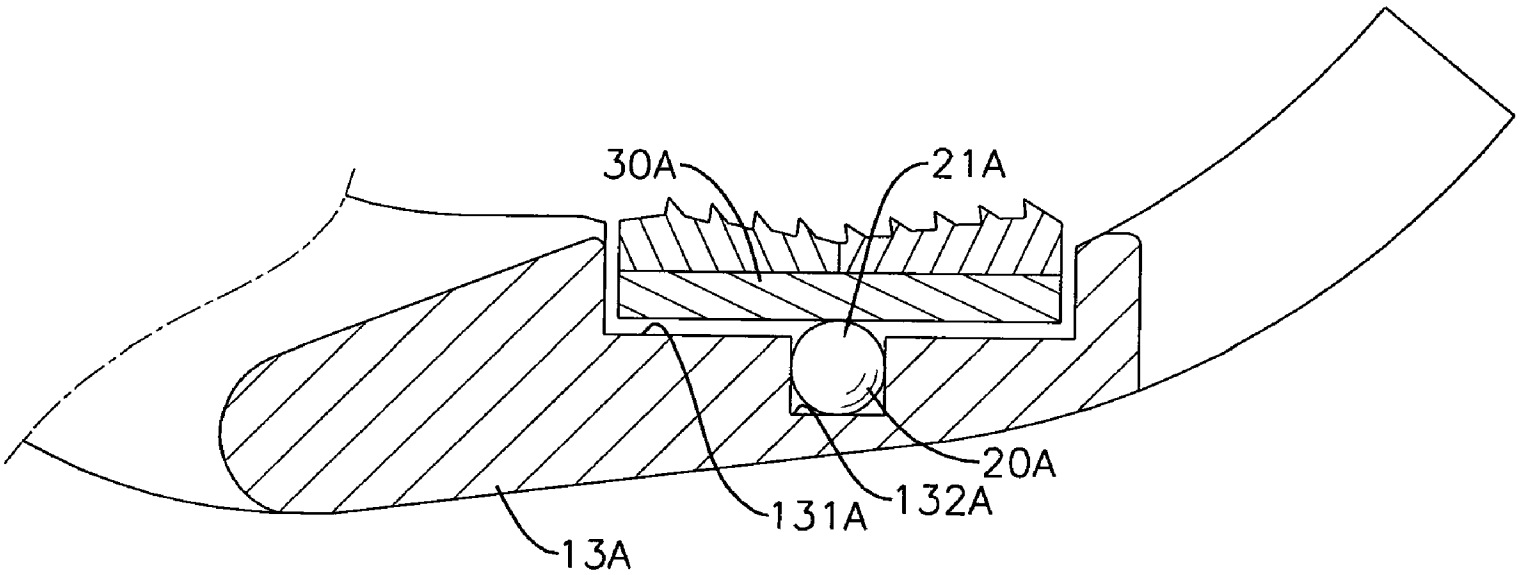
FIG. 8 is an enlarged side view in partial section of the rocker assembly in FIG. 7.
Figure 9:
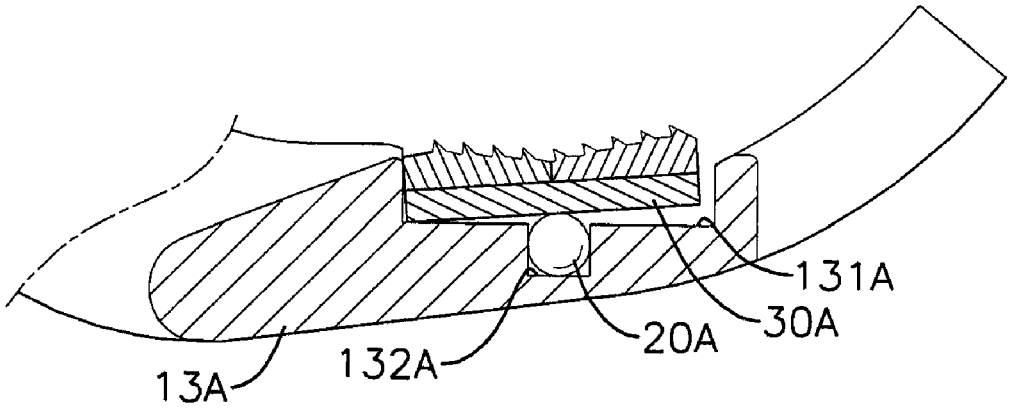
FIG. 9 is an enlarged operational side view in partial section of the rocker assembly in FIG. 7.
Figure 10:
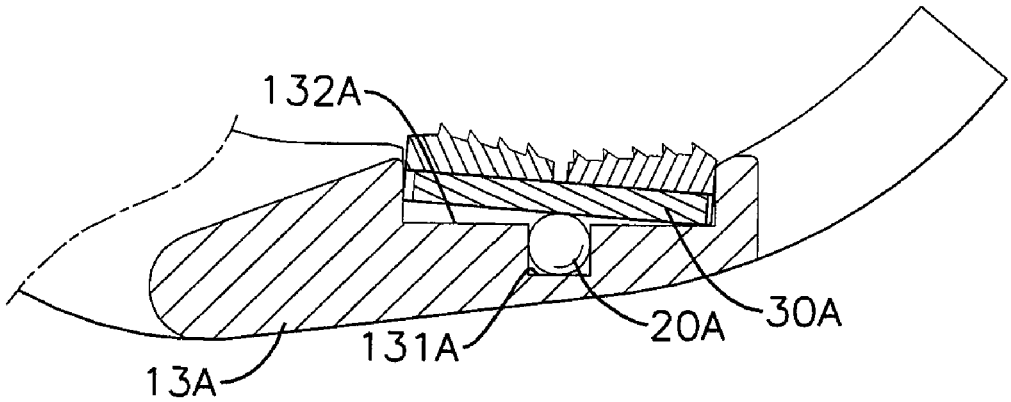
FIG. 10 is another enlarged operational side view in partial section of the rocker assembly in FIG. 7.
Figure 11:
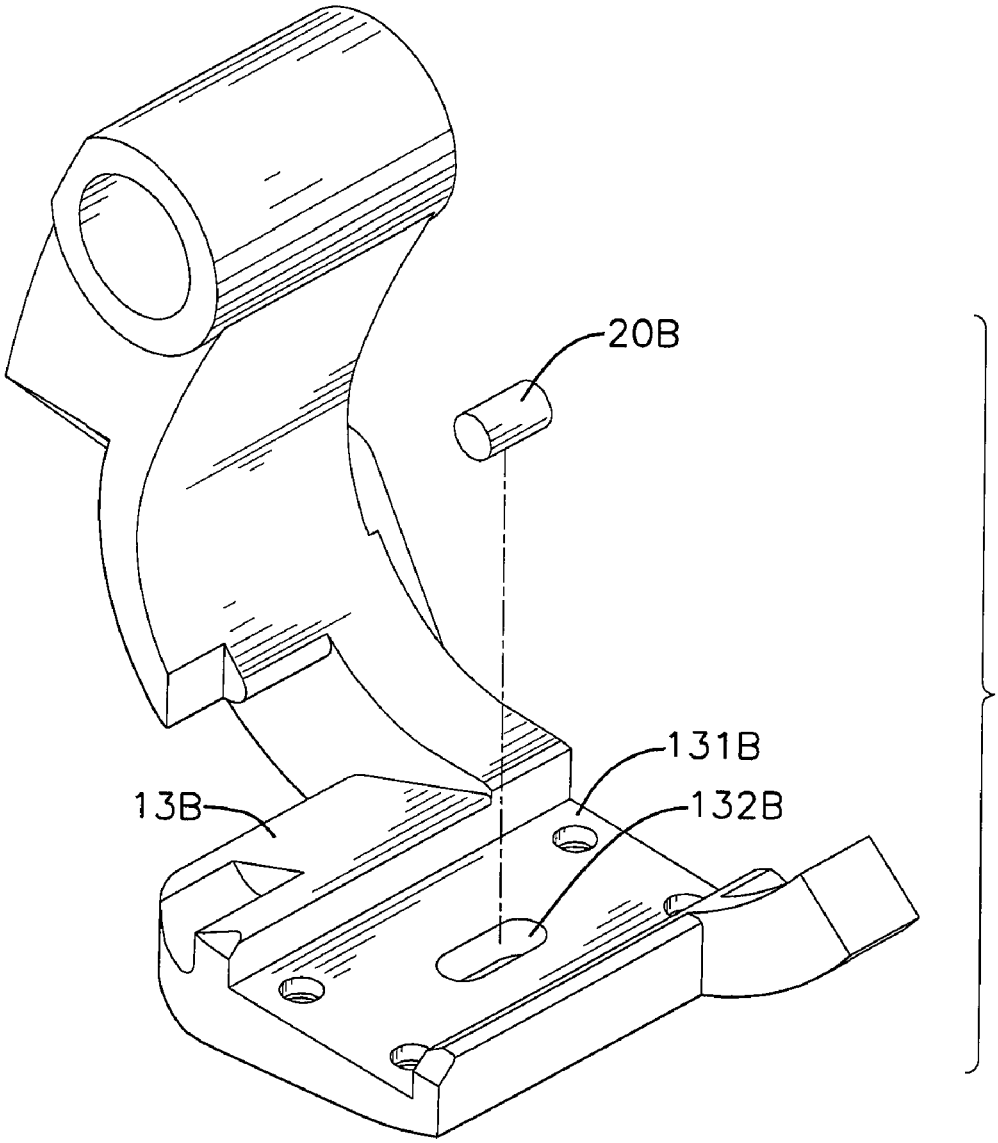
FIG. 11 is a partial exploded perspective view of a third embodiment of a rocker assembly of a strapping machine in accordance with the present invention.
Figure 12:
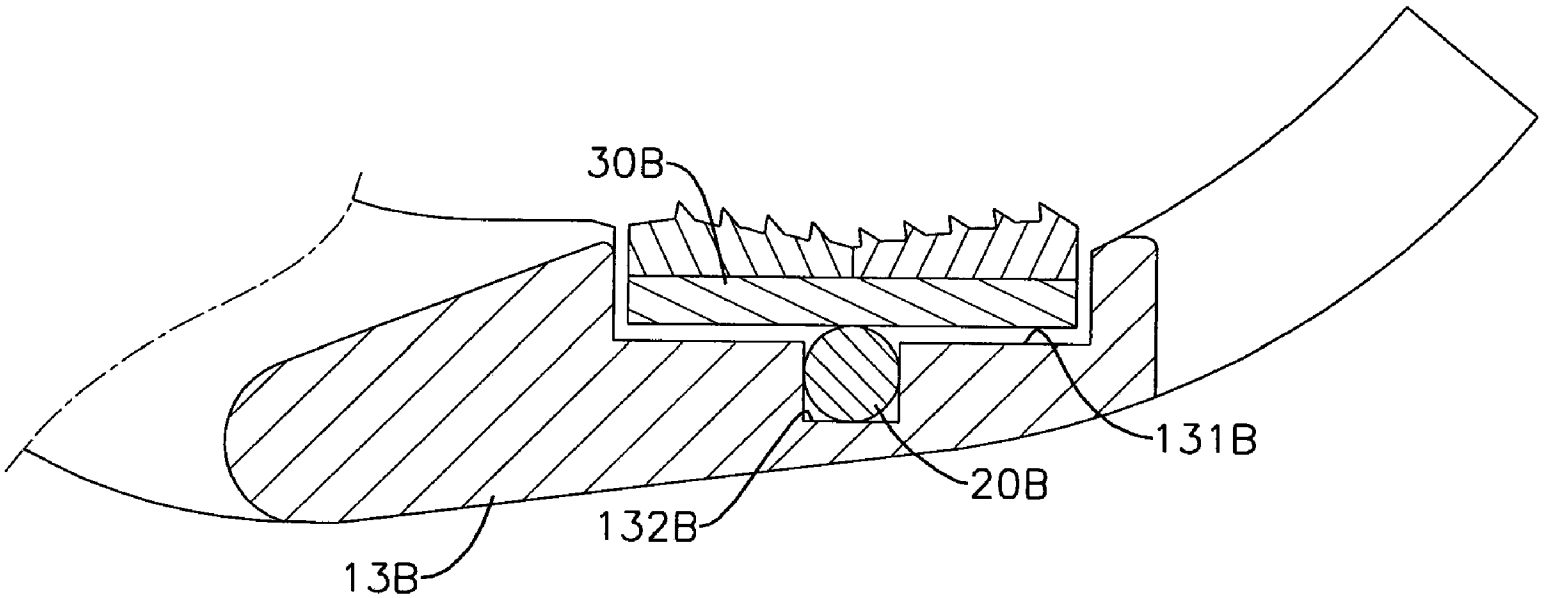
FIG. 12 is an enlarged side view in partial section of the rocker assembly in FIG. 11.
Figure 13:
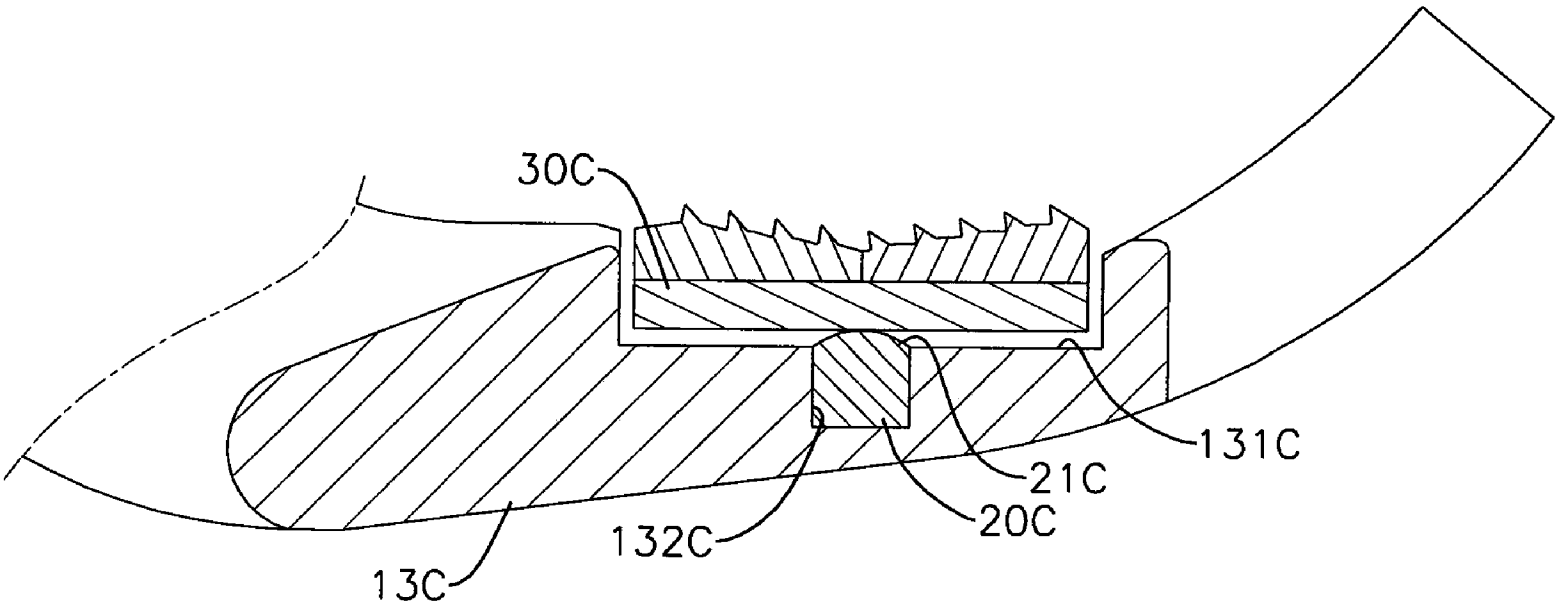
FIG. 13 is an enlarged side view in partial section of a fourth embodiment of a rocker assembly of a strapping machine in accordance with the present invention.
Figure 14:
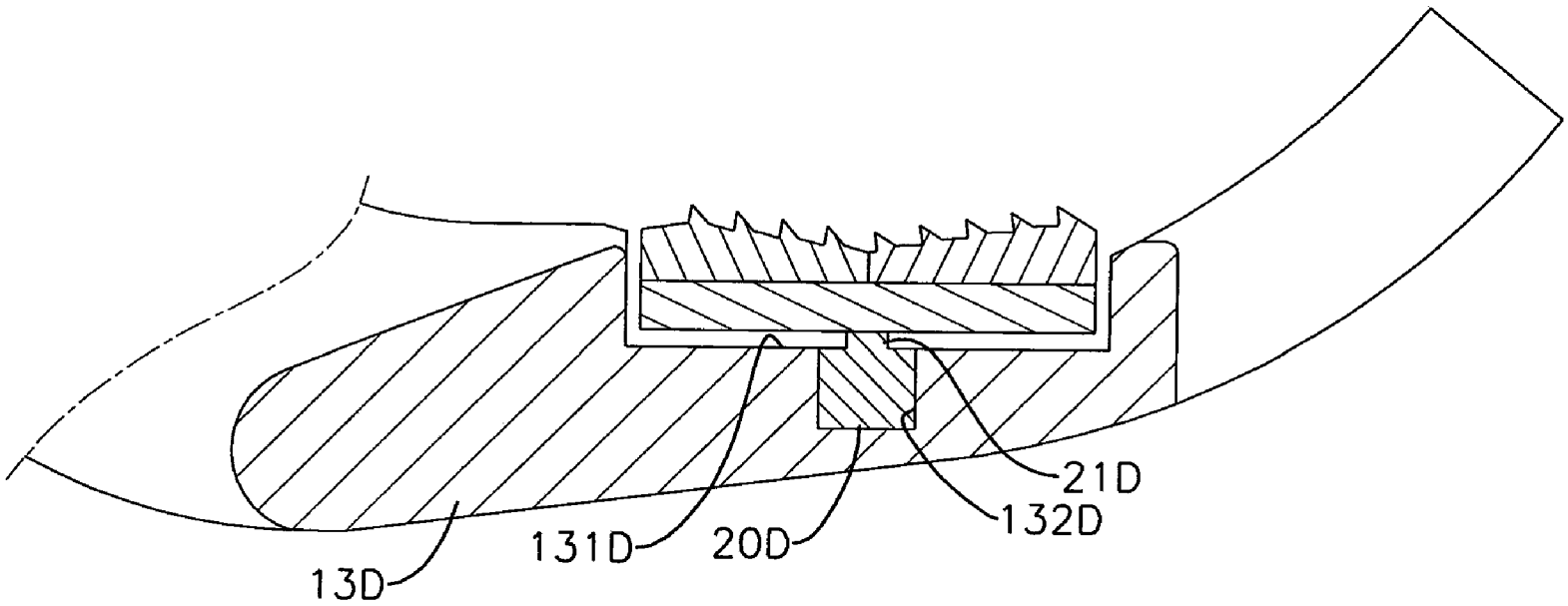
FIG. 14 is an enlarged side view in partial section of a fifth embodiment of a rocker assembly of a strapping machine in accordance with the present invention.
Figure 15:
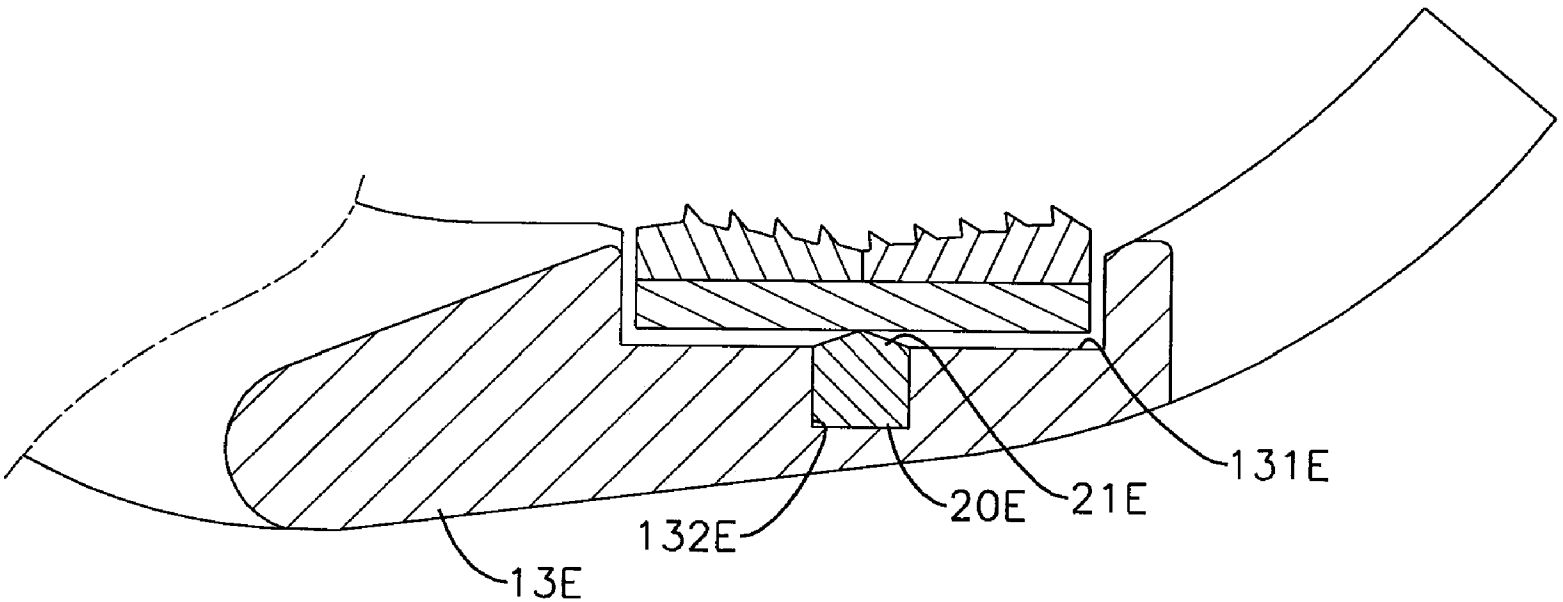
FIG. 15 is an enlarged side view in partial section of a sixth embodiment of a rocker assembly of a strapping machine in accordance with the present invention.
Figure 16:
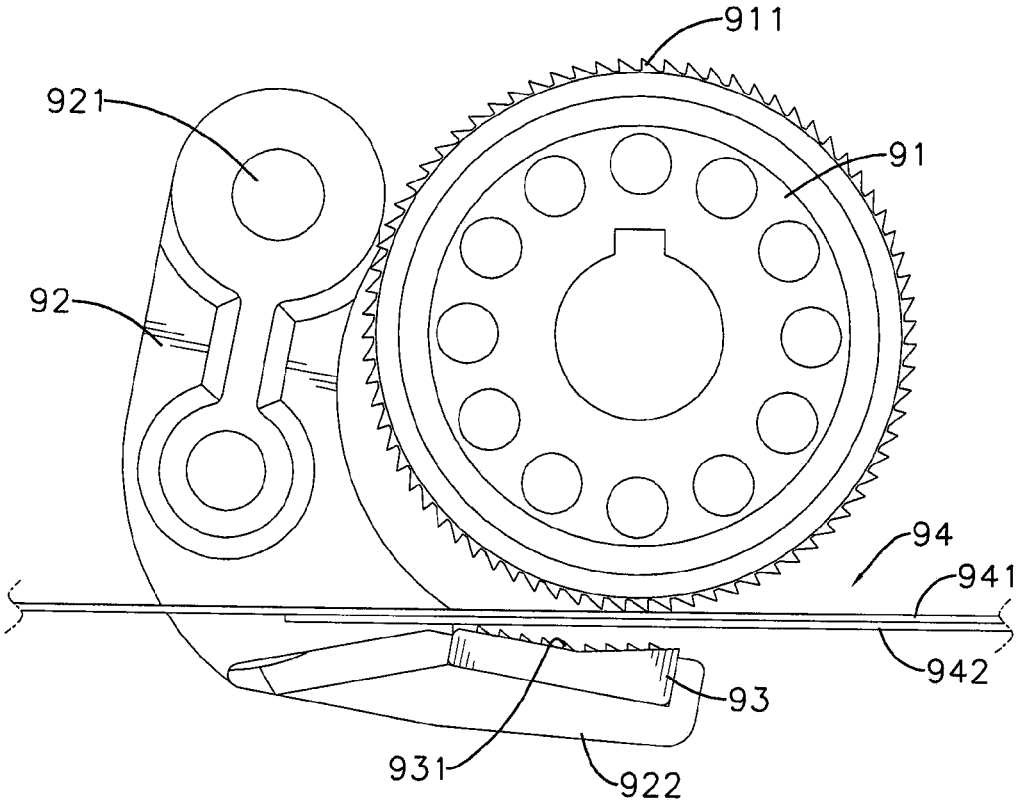
FIG. 16 PRIOR ART
FIG. 16 is a partial operational side view of a conventional strapping machine in accordance with the prior art.
Figure 17:
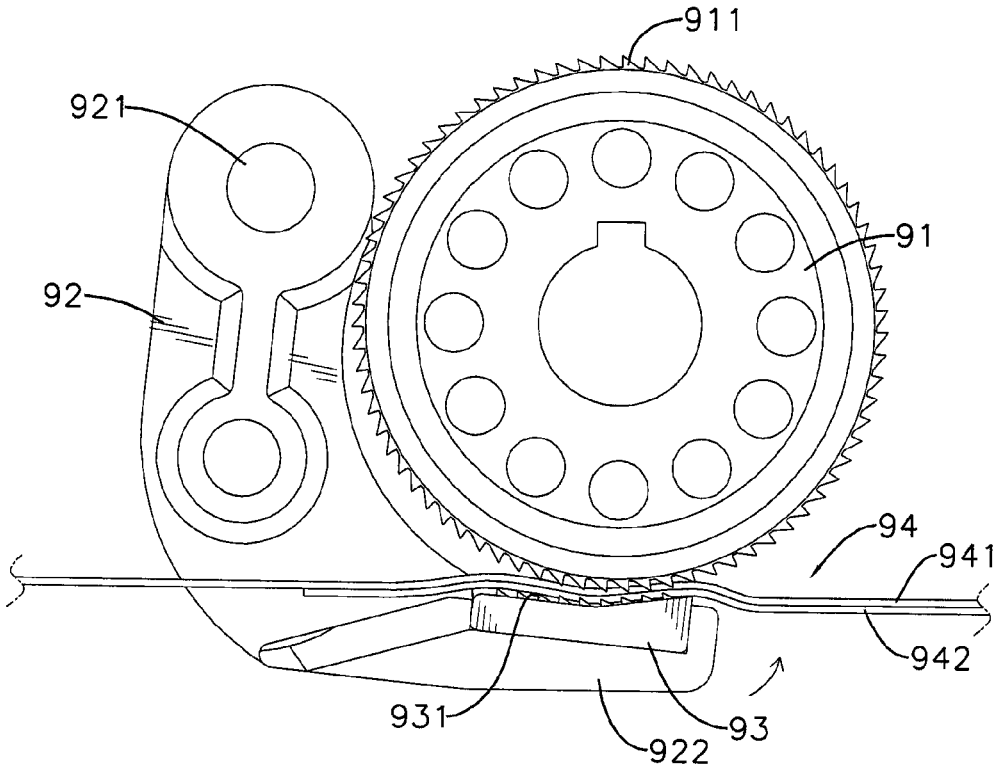
FIG. 17 PRIOR ART
FIG. 17 is another partial operational side view of the conventional strapping machine in FIG. 16.
Figure 18:
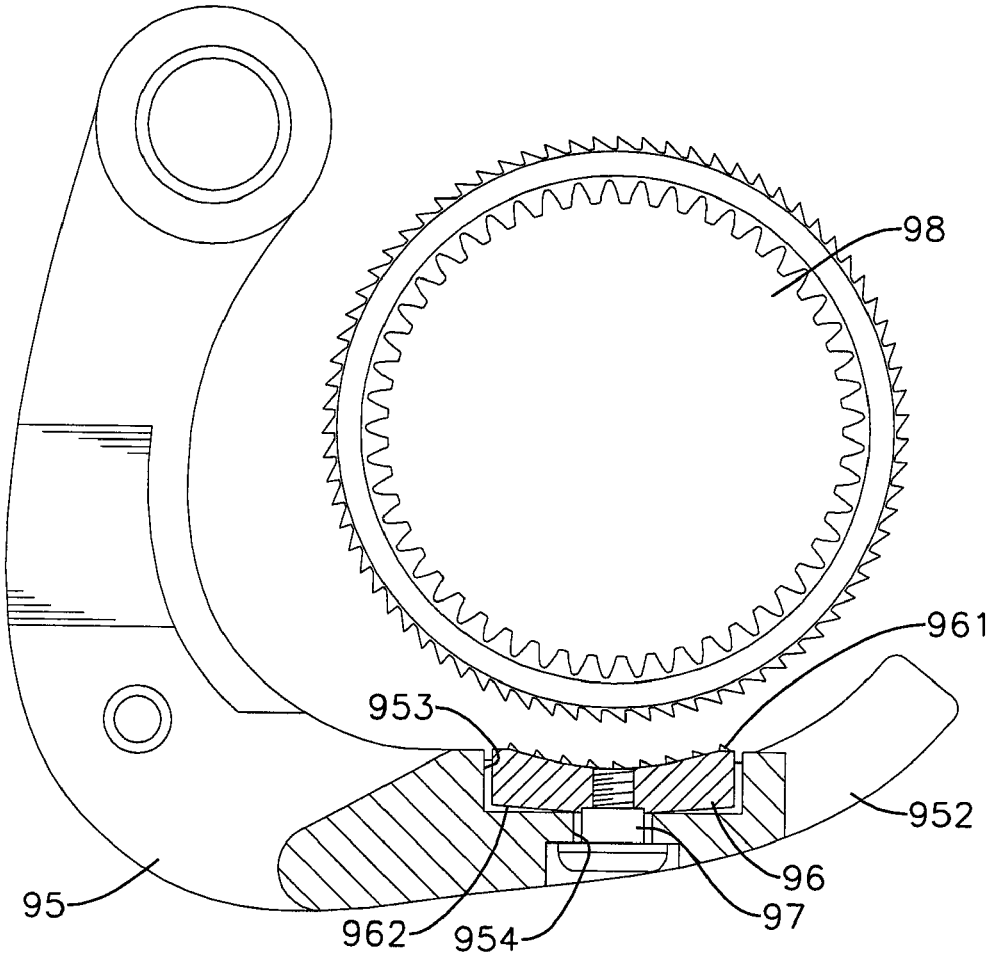
FIG. 18 PRIOR ART
FIG. 18 is a partial operational side view of another conventional strapping machine in accordance with the prior art.

The rocker assembly 1 may further comprise a support 20, 20B, 20C, 20D, 20E mounted in the internal recess 132, 132B, 132C, 132D, 132E of the rocker 10. The supporting protrusion 21, 21B, 21C, 21D, 21E is formed on a top of the supporter 20, 20B, 20C, 20D, 20E and protrudes into the mounting recess 131, 131B, 131C, 131D, 131E of the seat 13, 13B, 13C, 13D, 13E. As shown in FIGS. 5 and 6, the supporting protrusion 21 may be triangular in cross-section and has a front slope 211 and a rear slope 212. The front slope 211 slopes down toward the front of the seat 13. The rear slope 212 slopes down toward the rear of the seat 13. As shown in FIG. 11, the supporter 20B may be a round rod. As shown in FIGS. 13, 14, 15, the supporter 20C, 20D, 20E may correspond to and be embedded in the internal recess 132C, 132D, 132E of the seat 13C, 13D, 13E. The supporting protrusion 21C, 21D, 21E may be convex, may be rectangular in cross-section or may be triangular in cross-section.

The rocker assembly 1 may further comprise multiple supporters 20A. The supporters 20A are spherical and are mounted in and arranged along the internal recess 132A of the rocker 10.

With further reference to FIGS. 8 to 10 and 12, the positioning panel 30 is mounted in the mounting recess 131, 131A, 131B, 131C, 131D, 131E of the seat 13, 13A, 13B, 13C, 13D, 13E and on the supporting protrusion 21, 21A, 21B, 21C, 21D, 21E and selectively swings forwards and backwards along the front slope 211 and the rear slope 212 of the supporting protrusion 21.

The teeth panels 40, 50 are mounted on the positioning panel 30, are arranged parallel to the front and the rear of the seat 13, 13A, 13B, 13C, 13D, 13E and selectively slide toward the front and the rear of the seat 13, 13A, 13B, 13C, 13D, 13E. Each teeth panel 40, 50 has two sides, a toothed upper surface 41, 51, two sliding protrusions 42, 52 and a bottom recess 43, 53. The sides of the teeth panel 40, 50 respectively correspond to the sides of the seat 13, 13A, 13B, 13C, 13D, 13E. The sliding protrusions 42, 52 respectively protrude from the sides of the teeth panel 40, 50. The bottom recess 43, 53 is formed in a bottom of the teeth panel 40, 50 and through a front and a rear of the teeth panel 40, 50 and is mounted around the positioning panel 30. Thus, the teeth panels 40, 50 are able to slide along the positioning panel 30.

The holders 60 are securely mounted in the mounting recess 131, 131A, 131B, 131C, 131D, 131E of the seat 13, 13A, 13B, 13C, 13D, 13E and are respectively disposed adjacent to the sides of the seat 13. Each holder 60 has an inner side and a sliding recess 61. The inner side of the holder 60 corresponds to the teeth panels 40, 50. The sliding recess 61 is formed in the inner side of the holder 60 and is mounted around corresponding sliding protrusions 42, 52 of the teeth panel 40, 50 to prevent the teeth panels 40, 50 from falling off the seat 13 and to allow the teeth panels 40, 50 to slide forwards and backwards.

Preferably, the seat 13 further has multiple through holes 133. The through holes 133 are formed through the bottom of the seat 13 and are disposed adjacent to the sides of the seat 13. Multiple fasteners 71 are respectively mounted through the through holes 133 of the seat 13 to securely fasten the holders 60 with the seat 13.

With reference to FIG. 5, a wrapping strap 72 is wrapped around goods and has a tightening end 721 and a fixed end 722 overlapping each other. At first, the rocker lever 84 is pulled to drive the rocker assembly 1 to swing backward from the tensioning wheel 83 and the overlapping tightening end 721 and fixed end 722 of the wrapping strap 72 are placed between the rocker assembly 1 and the tensioning wheel 83. The fixed end 722 of the wrapping strap 72 corresponds to the teeth panels 40, 50 and the tightening end 721 of the wrapping strap 72 corresponds to the peripheral surface of the tensioning wheel 83. Thus, the teeth panel 40 that corresponds to the front of the seat 13, 13A, 13B, 13C, 13D, 13E and the seat 13, 13A, 13B, 13C, 13D, 13E are pressed by the wrapping strap 72 and swing toward the front of the seat 13, 13A, 13B, 13C, 13D, 13E.

With further reference to FIG. 6, then the rocker lever 84 is pulled to drive the rocker assembly 1 to swing forward toward the tensioning wheel 83. Thus, according to thickness of the wrapping strap 72, the teeth panels 40, 50 slide relative to each other to allow the toothed upper surfaces 41, 51 of the teeth panels 40, 50 to engage the fixed end 722 of the wrapping strap 72 and the teeth 831 of the tensioning wheel 83 to engage the tightening end 721 of the wrapping strap 72. Furthermore, the curved peripheral surface of the tensioning wheel 83 pushes the wrapping strap 72 to press on the teeth panel 50 that corresponds to the rear of the seat 13, 13A, 13B, 13C, 13D, 13E and the positioning panel 30 to swing toward the rear of the seat 13, 13A, 13B, 13C, 13D, 13E.

The rocker assembly 1 of the strapping machine as described has the following advantages. The two teeth panels 40, 50 are capable of sliding relative to each other and swinging when the positioning panel 30 swings. Therefore, the teeth panels 40, 50 automatically adjust engaging surfaces and engaging forces between the teeth panels 40, 50 and the wrapping strap 72 to allow the tensioning wheel 83 and the teeth panels 40, 50 to securely hold the wrapping strap 72. As long as engagements between the teeth panels 40, 50, the tensioning wheel 83 and the wrapping strap 72 are enhanced, the wrapping strap 72 is able to securely wrap around the goods and is not scratched.

What is claimed is:

1. A rocker assembly of a strapping machine comprising
a rocker having
a pivoting end;
a swinging end; and
a seat formed on the rocker, disposed adjacent to the swinging end and having
a front corresponding to the pivoting end of the rocker;
a rear corresponding to the swinging end of the rocker;
two opposite sides;
a mounting recess formed in an upper surface of the seat;
a bottom defined in the mounting recess; and
a supporting protrusion formed on the bottom of the seat and extending toward the sides of the seat;
a positioning panel mounted in the mounting recess of the seat and on the supporting protrusion;
two teeth panels mounted on the positioning panel, arranged parallel to the front and the rear of the seat and selectively sliding toward the front and the rear of the seat, and each teeth panel having
two sides respectively corresponding to the sides of the seat;
a toothed upper surface; and
two sliding protrusions respectively protruding from the sides of the teeth panel; and
two holders securely mounted in the mounting recess of the seat and respectively disposed adjacent to the sides of the seat, and each holder having
an inner side corresponding to the teeth panels; and
a sliding recess formed in the inner side of the holder and mounted around corresponding sliding protrusions of the teeth panel.

2. The rocker assembly as claimed in claim 1, wherein
the seat of the rocker further has an internal recess formed in the bottom of the seat and extending toward the sides of the seat;
the rocker assembly further comprises a supporter mounted in the internal recess of the rocker;
the supporting protrusion is formed on a top of the supporter and protrudes into the mounting recess of the seat.

3. The rocker assembly as claimed in claim 1, wherein each teeth panel further has a bottom recess formed in a bottom of the teeth panel and through a front and a rear of the teeth panel and mounted around the positioning panel.

4. The rocker assembly as claimed in claim 2, wherein each teeth panel further has a bottom recess formed in a bottom of the teeth panel and through a front and a rear of the teeth panel and mounted around the positioning panel.

5. The rocker assembly as claimed in claim 2, wherein the supporter is a round rod.

6. The rocker assembly as claimed in claim 4, wherein the supporter is a round rod.

7. The rocker assembly as claimed in claim 2, wherein
the supporter corresponds to and is embedded in the internal recess of the seat; and
the supporting protrusion is convex.

8. The rocker assembly as claimed in claim 4, wherein
the supporter corresponds to and is embedded in the internal recess of the seat; and
the supporting protrusion is convex.

9. The rocker assembly as claimed in claim 2, wherein
the supporter corresponds to and is embedded in the internal recess of the seat; and
the supporting protrusion is rectangular in cross-section.

10. The rocker assembly as claimed in claim 4, wherein
the supporter corresponds to and is embedded in the internal recess of the seat; and
the supporting protrusion is rectangular in cross-section.

11. The rocker assembly as claimed in claim 2, wherein
the supporter corresponds to and is embedded in the internal recess of the seat; and
the supporting protrusion is triangular in cross-section.

12. The rocker assembly as claimed in claim 4, wherein
the supporter corresponds to and is embedded in the internal recess of the seat; and
the supporting protrusion is triangular in cross-section.

13. The rocker assembly as claimed in claim 1, wherein
the seat of the rocker further has an internal recess formed in the bottom of the seat and extending toward the sides of the seat; and
the rocker assembly further comprises multiple spherical supporters mounted in and arranged along the internal recess of the rocker.

* * * * *